US006138413A

United States Patent [19]

Fehr

[11] Patent Number: 6,138,413

[45] Date of Patent: Oct. 31, 2000

[54] STANDARDIZED FRAMING SECTION FOR CLOSURE WINGS

[75] Inventor: Victor William Fehr, Morden, Canada

[73] Assignee: Huron Window Corporation, Morden, Canada

[21] Appl. No.: 08/764,338

[22] Filed: Dec. 12, 1996

[51] Int. Cl.[7] ..... E05D 7/02

[52] U.S. Cl. ..... 49/382; 49/504; 49/471

[58] Field of Search ..... 49/501, 504, 467, 49/471, 382

[56] References Cited

U.S. PATENT DOCUMENTS

| | | | |
|---|---|---|---|
| 3,349,519 | 10/1967 | Nehlig | 49/504 |
| 3,545,135 | 12/1970 | Lieber | 49/505 |
| 3,702,517 | 11/1972 | Martin | 49/504 |
| 3,858,375 | 1/1975 | Silvernail | 52/235 |
| 4,328,644 | 5/1982 | Scott et al. | 49/504 X |
| 4,831,779 | 5/1989 | Kebrii et al. | 49/471 |
| 4,831,781 | 5/1989 | Morton | 49/504 |
| 4,941,288 | 7/1990 | Morton | 49/504 |
| 4,944,118 | 7/1990 | Biro | 49/504 |
| 5,003,747 | 4/1991 | Morton | 52/656 |
| 5,012,614 | 5/1991 | Shea | 49/468 |
| 5,105,581 | 4/1992 | Slocomb, Jr. | 49/504 |
| 5,136,814 | 8/1992 | Headrick | 49/468 |
| 5,179,804 | 1/1993 | Young | 49/471 |
| 5,274,955 | 1/1994 | Dallaire et al. | 49/504 X |
| 5,289,659 | 3/1994 | Harrison | 49/504 X |
| 5,345,722 | 9/1994 | McKann | 49/505 |

FOREIGN PATENT DOCUMENTS

| | | | |
|---|---|---|---|
| 1122069 | 4/1982 | Canada | 108/68 |
| 1326788 | 5/1988 | Canada | 108/73 |
| 1322302 | 7/1989 | Canada | 108/67 |
| 0 333 293 | 3/1989 | European Pat. Off. | E06B 1/60 |

*Primary Examiner*—Jerry Redman

*Attorney, Agent, or Firm*—Neil H. Hughes; Ivor M. Hughes; Marcelo K. Sarkis

[57] ABSTRACT

A standard sized, or standard shaped profile for use as header, sill, latch jamb and/or striker jamb portions within a framing section, each of the standard shaped and sized profiles includes a first side and a second side wherein are provided mounting portions to mount the framing sections via a supplementary member engaged with the mounting portions to a wall adjacent an opening and thereby enable a wing pivoted from said completed frame to be swung inwardly in a first embodiment or outwardly in a second embodiment from framing sections made from the identical profiles.

14 Claims, 6 Drawing Sheets

21
22
23
16
D1
19
17
10
20
15
25
18a
18
B

STANDARDIZED FRAMING SECTION FOR CLOSURE WINGS

FIELD OF THE INVENTION

This invention relates to standardized framing sections, for example, sills, headers, striker jambs and hinge jambs for a closure wing such as a door, window or the like. The invention finds particular application to doors which may be pivoted inwardly or outwardly being supported from the standard framing sections.

BACKGROUND OF THE INVENTION

In order to mount a door or window that pivots within a building opening, normally a framing section is provided from which the wing such as a door or window is pivoted. These framing sections are joined to the reinforcing plates which surround the opening which are typically made from wood. The framing sections are then fastened to these wooden plates, and typically allowances are made for ensuring that the vapour seal on the warm side of the building are integrated with the framing section. The framing section so provided may be made from wood, plastic, metal such as aluminium, and fiberglass. Whatever framing section is provided, typically the vapour seal butts to the header, the striker jamb or the hinge jamb, but is not normally provided on the sill. When sills are made from plastic such as PVC or other hollow members, they are often reinforced with wood. It is important in this situation to provide drainage of the sills to prevent rotting of the wood. The wood therefore must be sealed against the elements. It is a necessary reinforcing member for the sill, but introduces into the structure the risk of rotting if not properly drained. A need therefore to eliminate this concern exists.

Doors or windows pivoted from framing sections typically pivot inwardly from the framing section or outwardly from the framing section. In this sense, "inwardly" refers to the pivoting of, for example, a door into the space defined by a room or a building, and a door which pivots "outwardly" is one that pivots from the framing section away from the space defined by the room or building. Quite often the installer will select the direction of pivoting of a door which best makes use of the space while addressing all of the issues required by fire codes within the respective countries. Another consideration when deciding in which direction to pivot a door or a window is the direction of the prevailing winds in that particular area. For example, a door which pivots outwardly from a building may be ripped from its hinges if typical wind velocities are significant in that particular geographical location. Of course, as mentioned above, as required by fire regulations within particular states and provinces, most exit doors from buildings pivot outwardly away from the building to allow for crash bars and the installation thereof on the interior side of each door.

Examples of known structures for windows and doors are set out below. A door may be defined as anything which pivots from a framing section whether it be a patio door, an interior door, an exterior door, an storm aluminum door, or the like. With reference to the term "window", Applicant is referring to windows which pivot from a framing section into the space of a room or out from the space of a room, such as a casement-type window which typically pivots outwardly, or a pivoting window which may pivot inwardly.

Installers, when installing a window, or a door, or alternatively any wing, must decide at the time of installation prior to installing the framing section as to what direction the wing will pivot. Once this decision is made, the framing section is installed in a manner so as to provide for the pivoting of that assembly. It would therefore be advantageous if a framing section were provided which were standardized to allow for the installation thereupon of a wing such as a door or window that pivots from the framing section either inwardly or outwardly with respect to the space being closed by the wing.

Referring now to Canadian Patent No. 1,326,788 assigned to the Aluminum Company of America, there is described a window structure including mitered corner joints which are fusion welded. The frame includes a pair of vertical jamb members connected rigidly to horizontal header and sill members. Each of the members are formed from an extruded plastic material. In one embodiment, the header and sill members include sloping walls and sloping wall mating portions as best seen in the figures, and specifically FIG. 4. In another embodiment, the inner and outer sections making up the jamb and header members include interfitting ribs and channel shaped portions forming a snap fit connection in the assembly. U.S. Pat. No. 4,831,781 issued to the same assignee from which the aforementioned Canadian patent claims priority. That assignee also has another U.S. Pat. No. 5,003,747, teaching a similar structure.

Referring now to European Patent Application No. 333, 293 which was published on Sep. 20, 1989, there is disclosed a window or door frame made from plastic materials including jambs and a header wherein each of the portions are anchored directly to a wall leaf by co-acting coupling members and counter-coupling members used in conjunction with a plastic frame as best seen in FIG. 5.

U.S. Pat. No. 4,941,288 issued Jul. 17, 1990 describes framing structures for windows wherein the jamb header and sill members are all formed from extrusions of rigid plastic and inner and outer sections which snap fit in relation to one another. The frame is fusion welded having mitered corner joints and has a sill with a low profile.

U.S. Pat. No. 5,105,581 describes a window frame made of plastic material connected together with corner connectors and which corners are ultimately ultrasonically welded.

U.S. Pat. No. 3,858,375 issued Jan. 7, 1975 describes a curtain wall which includes internal weep holes and feed passages therein to provide for the venting of moisture.

Canadian Patent No. 1,322,302 corresponding to U.S. Pat. No. No. 4,831,779 to the Schlegel Corporation describes a self-draining panel threshold including an open-ended water trough in the threshold which extends from one jamb to another and lies in a weather seal plane. In one of the embodiments, the sill has an incline surface that is inclined downwardly toward the water trough of the invention and allows for the water to run down the upper surface of the sill into the water trough and from the trough as best seen in FIG. 2 and 3 outwardly away from vented flapped passage 90 to the exterior.

U.S. Pat. No. 5,179,804 issued Jan. 19, 1993 also describes a self-draining door sill as best seen in FIG. 3.

U.S. Pat. No. 5,136,814 also teaches a draining door sill arrangement. Any rain water seeps under the threshold cap and into the channel flowing to the end of the channel to the drain trough at the cap end as seen in FIG. 1 at item 44.

U.S. Pat. No. 5,012,614 issued May. 6, 1991 teaches a thermoplastic threshold manufactured by blow molding techniques and being of one-piece construction to rest on a horizontal jamb and having stiffener ribs disposed proximate the bottom thereof. Openings are provided to allow water to flow within a channel through said openings for draining of the threshold.

U.S. Pat. No. 3,545,135 issued Dec. 8, 1970 describes a door jamb construction made from extruded plastic. The two portions making up each jamb include a male and female section which interfit to form said jamb portion.

U.S. Pat. No. 3,702,517 issued Nov. 14, 1972 teaches the use of a unitary plastic door frame for defining the head and jambs of a door opening. The structure is best seen in FIGS. 2, 3 and 4.

U.S. Pat. No. 3,349,519 issued Oct. 31, 1967 also describes plastic materials used for door frames when engaging with the edges of a wall.

Referring now to U.S. Pat. No. 5,345,722, there is described and illustrated adjustable door framing portions formed from plastic including latch jamb, hinge jamb and header jamb assemblies. The assembly ay include or may not include exterior trim. Each portion, i.e. the latch jamb is formed from a single piece of extruded plastic and particularly vinyl.

Canadian Patent No. 1,122,069 issued Apr. 20, 1982 describes a door frame assembly including metal back or jamb members and vinyl jamb members snap engageable with the metal backers, as per the reference figures, usable for the hinge jamb and the latch jambs as best seen in FIGS. 3 and 4 and described at the appropriate locations corresponding to those figures in the disclosure.

Nothing within the prior art describes or teaches a standard sized, or standard shaped profile for use as header, sill, latch jamb and striker jamb portions within a framing section. Each of the standard shaped and sized profiles includes a first side and a second side wherein are provided mounting portions to mount the framing sections via a supplementary member engaged with the mounting portions to a wall adjacent an opening and thereby enable a wing pivoted from said completed frame to be swung inwardly in a first embodiment or outwardly in a second embodiment from framing sections made from the identical profiles.

It is therefore a primary object of the invention to provide a standard framing profile which is simple to manufacture and easy to use which obviates many of the problems in the prior art.

It is a further object of this invention to provide a standard framing profile which interfits with like profiles to provide a frame about a building opening from which a closure wing pivots.

It is yet a further object of the invention to provide a standard framing profile which includes all of the features required to seal, drain, and hang said profile when installed as for example a sill section.

It is yet a further object of the invention to provide a standard framing profile which includes a feature allowing for pivoting a wing from a framing section formed from said standard framing profiles as either an inwardly-pivoting wing or an outwardly-pivoting wing without the necessity to change the framing section so installed.

Further and other objects of the invention will become apparent to those skilled in the art when considering the following summary of the invention and the more detailed description of the preferred embodiments illustrated herein.

SUMMARY OF THE INVENTION

According to a primary aspect of the invention, there is provided a standard substantially hollow profile for use in the assembly of framing sections for supporting a pivoting wing such as a door or window within an opening in a building, said profile comprising a preferably extruded section preferably of flexible material such as thermoplastic material or polyvinyl chloride or the like (reinforced or not reinforced with materials within the matrix making up the extradite such as with fiberglass fibres), having a top, two sides and a bottom, said top and bottom having extending within the hollow therebetween reinforcing portions (for example webs of material) extending substantially between said top and said bottom and joining said top and said bottom (for example vertical webs of material), as well as preferably extending between said sides of said profile and joining said sides (for example horizontal webs of material), preferably said reinforcing portions (vertical and horizontal webs of material) creating a predetermined number of closed sections or cells within the interior of said profile which rigidify the load carrying ability of said profile, said profile including proximate the top thereof adjacent one side thereof a pocket within which a wing such as a door may be located in use and when the door or wing is in the closed position, said pocket having disposed adjacent thereto a preferably horizontally extending recess for receiving a seal and preferably a compression seal, when installed in said profile said seal including at least one and preferably two tangs for a friction fit engagement within said recess to retain said compression seal in position for butting against the wing in a closed position, said profile having disposed proximate preferably each side thereof a detent for engaging with a brick molding or supplementary mounting member for mounting said profile adjacent a building opening, said detent preferably being a recess and being disposed proximate each side of said profile, preferably the top of said profile being tapered toward one side of said profile away from the pocket, wherein said profile may be joined with like profiles preferably at mitered corners and being fusion welded thereat so as to form a framing section which may be installed within standard or alternative sized openings within a building to pivotably retain a wing or a door.

In a preferred embodiment, the profile includes a recess proximate the bottom thereof for receiving a rolled foam cylinder to retain a vapour seal therein.

In another embodiment, the bottom of said profile includes a larger recess to contain a reinforcing section for example flat bar or steel bar, for reinforcing the profile.

In another embodiment, said profile includes a reinforcing flat bar contained within a reinforcing cell located just adjacent the pocket within which said door will be mounted by hinges, said reinforcing bar for receiving the fasteners of said hinges and reinforcing them in that particular location.

In another embodiment, the top of said framing section when utilized as a sill may further comprise a supplementary sill cap which is fastened in position proximate the pocket via a recess formed within said profile adjacent said pocket for containing and receiving tangs provided with said supplementary sill cover plate and being fastened proximate the other end via a fastener driven into said profile.

In another embodiment, drainage holes may be formed, for example drilled, punched or melted through the vertical webs of said reinforcing of said profile to allow for the drainage of said profile when used as a sill. Preferably, the horizontal web joining the sides of said profile extending within the hollow exterior thereof is tapered from proximate the pocket and extends to the other side of the profile within the hollow thereof (and preferably to the tapered side of the profile) to allow for drainage of said profile.

In a preferred embodiment, the aforementioned profile is utilized to prepare a framing section for supportedly pivoting a door. Preferably said framing section including a sill, a header, a striker jamb and a hinge jamb. Preferably, all of said header, sill, striker and hinge jamb portions being mitered and fusion welded or the like proximate the corners thereof and sealed with appropriate sealant to provide a framing section, said framing section being manufactured from standard shaped profiles as described above and which is mounted to the wooden framing plates adjacent the opening of a building via supplementary brick moldings anchored or fastened to the preferred side of said profile via the detent or recess provided at those sides depending on whether said wing (door or window) will pivot inwardly into the space of the building or outwardly therefrom.

According to another aspect of the invention, there is provided a framing section for a closure wing, said wing being pivotable proximate one side edge thereof to and from an open and closed position when the free side of the wing is moved to and from the open and closed position, for example said wing being a door mounted on hinges within the framing section, said framing section comprising a standard section profile, preferably an extrusion, preferably manufactured from flexible materials such as polyvinyl chloride, and for providing a sill section, a header section, a striker jamb section and a hinge jamb section, all sections being interconnected at preferably mitered corners and being joined, for example fusion welded, thereat, said framing section being mounted within an opening provided within a building each framing section being rigidified by reinforcing portions within the interior hollow thereof, each framing section having two sides, a top and a bottom and having disposed proximate the sides thereof means for mounting said framing section to a supplementary portion (such as a brick molding) to be fastened to said building, one side of said framing sections including a pocket located proximate the top of said framing section and extending toward the bottom of said framing section, said pocket also including a channel or the like for receiving a seal, preferably the top of said framing section being tapered toward one side of the section and extending from said pocket to that side, said taper being utilized to allow for the shedding of water, snow and the like from said framing section, said section also including in one embodiment drainage ports which extend through the reinforced sections within the hollow of the framing section to provide for the draining of water away from said framing section, wherein said framing section is mounted within the building opening by the supplementary portions being fastened to the normally wooden plates adjacent the opening of said building and wherein said supplementary portions engage with the means for mounting said framing section to the supplementary portion of said profile. The framing section so defined will allow for the pivoting of the closure wing as a substantially inwardly pivoting wing or alternatively as a substantially outwardly pivoting wing depending on which side of the standard framing section that the supplementary member is mounted from, said wing residing in use within the pocket provide by said sections and being moveable to and from the pocket defined within the joined framing sections, preferably said framing sections being joined together at mitered ends preferably at 45° and being ultrasonically or fusion welded thereat. In one embodiment said welds are filled with a siliconetype material to improve the insulation qualities of the section. In a preferred embodiment, a sill cap is placed on the tapered framing section making up the sill for the doorway, said sill cap also being manufactured from a thermoplastic flexible material such as polyvinyl chloride or nylon. It is recommended that the material be durable. In a preferred embodiment, the pocket which provides the recess within which the door is received in the framing section when the wing is in the closed position also includes a fastening portion for anchoring the hinges of, for example, a door or alternative wing therein using screws or the like and which may include a backing plate for said screws disposed within said hollow reinforcing section. In another embodiment, channels, grooves and the like are provided within the standardized framing section to incorporate: a seal for sealing the closure wing within the pocket, a foam rod for retaining a vapour seal to the framing section without using nails, staples or sealant, and the supplementary mounting member.

According to yet another aspect of the invention, there is provided a standardized framing section profile for use as a header, sill, latch jamb or strike jamb portion within a framing section, each of said standard shaped sized framing portions including a nose portion and a heel portion when observed in cross section which are engageable with mounting portions to mount the framing section within a building opening proximate the heel or nose portion by a mounting channel or detent adjacent the heel or nose wherein the wing, such as a door, may be swung inwardly or outwardly depending on at which end whether the toe or the heel, the supplementary mounting portion is mounted.

According to a preferred embodiment of the invention, the heel portion includes a pocket providing in combination with the other standard framing sections a recess within which the door may reside when closed and which further includes in one embodiment a metal fastening or backing plate for mounting the hinge components for the wing. In another embodiment, the framing sections when joined include drainage ports to drain water from the framing section away from the framing section.

Further there is provided a standardized extruded hollow reinforced plastic profile comprising a toe and a heel wherein adjacent the toe and heel there are located portions formed with the profile for engaging with supplementary mounting portions to mount the profiles when assembled with like profiles as a framing section adjacent a wall defining a building opening, wherein the framing section so formed may be used to pivotally support a pivoting wing and preferably wherein said profiles include integral supplementary features such as a drainage gutter, and a polyethylene vapour seal attachment incorporated therewith.

According to yet another aspect of the invention there is provided a standard sized, or standard shaped profile for use as header, sill, latch jamb and/or striker jamb portions within a framing section, each of the standard shaped and sized profiles includes a first side and a second side wherein are provided mounting portions to mount the framing sections via a supplementary member engaged with the mounting portions to a wall adjacent an opening and thereby enable a wing pivoted from said completed frame to be swung inwardly in a first embodiment or outwardly in a second embodiment from framing sections made from the identical profiles.

DETAILED DESCRIPTION OF THE PREFERRED EMBODIMENTS OF THE INVENTION

Figure 1:
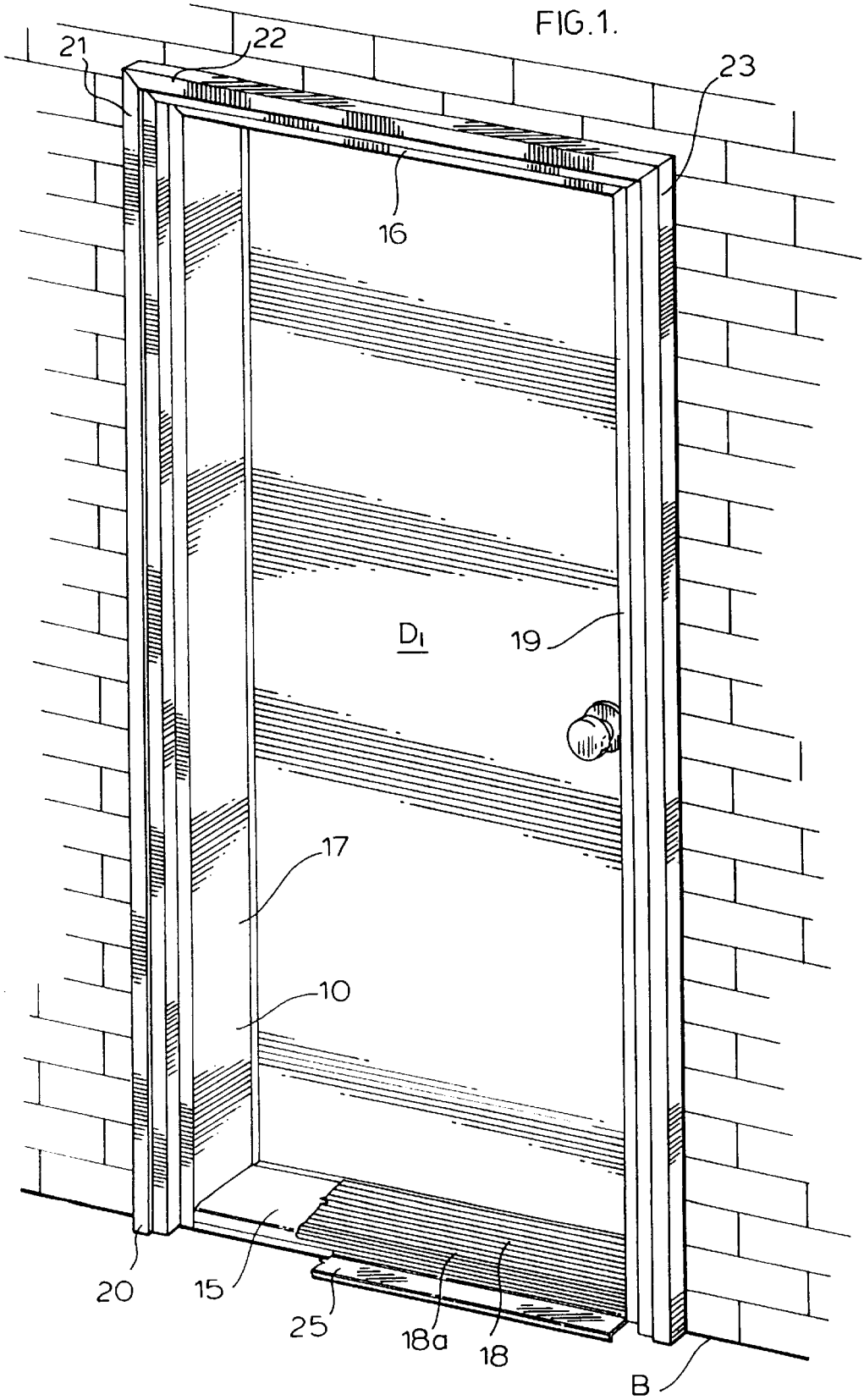
FIG. 1 is a perspective view of an inwardly-opening door suspended from framing sections made up from the standard size and shape profile embodying the invention and illustrated in a preferred embodiment of the invention.
Figure 2:
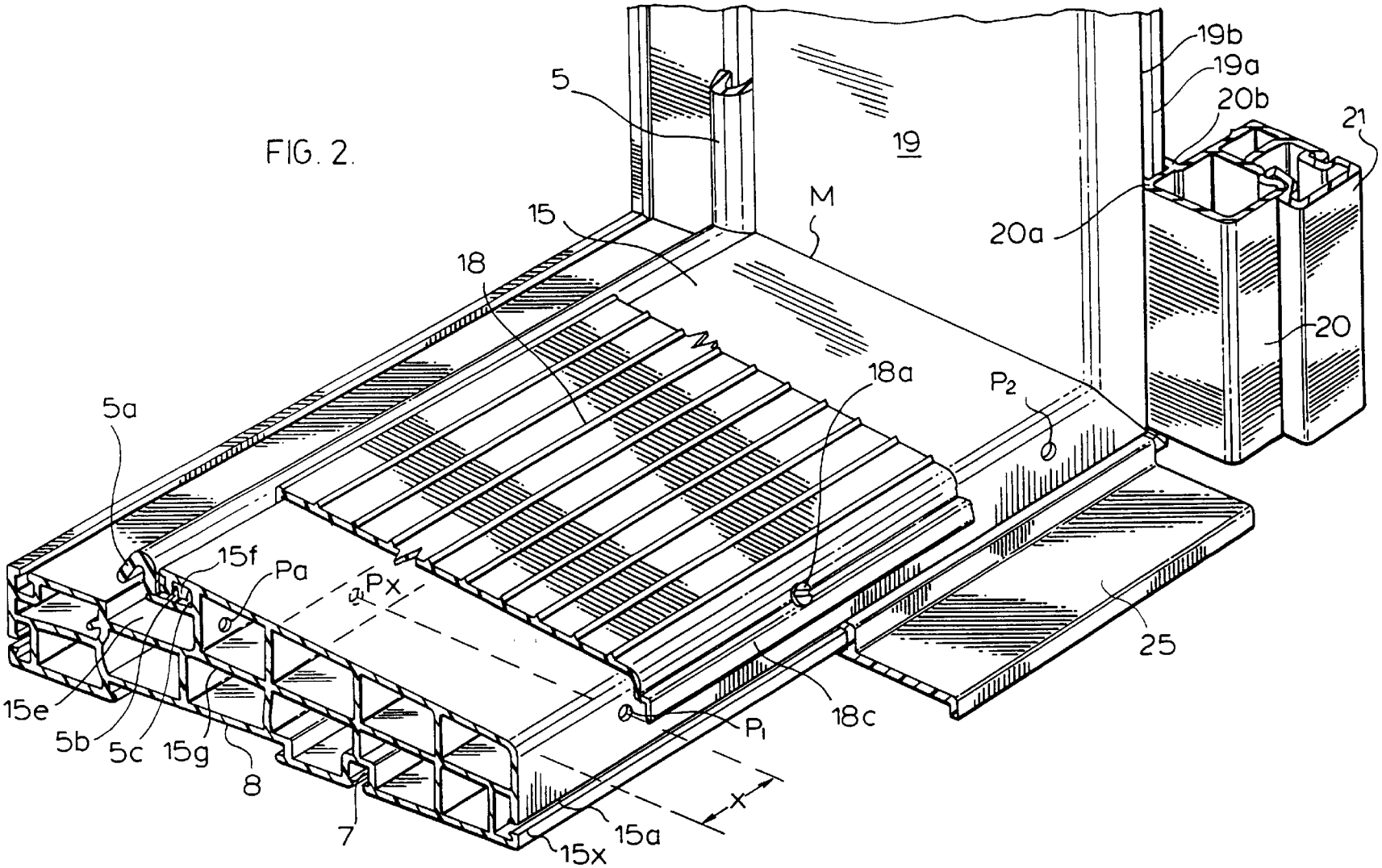
FIG. 2 is a cut-away perspective view of the sill of the door assembly of FIG. 1 illustrating the components thereof in a preferred embodiment of the invention.
Figure 3:
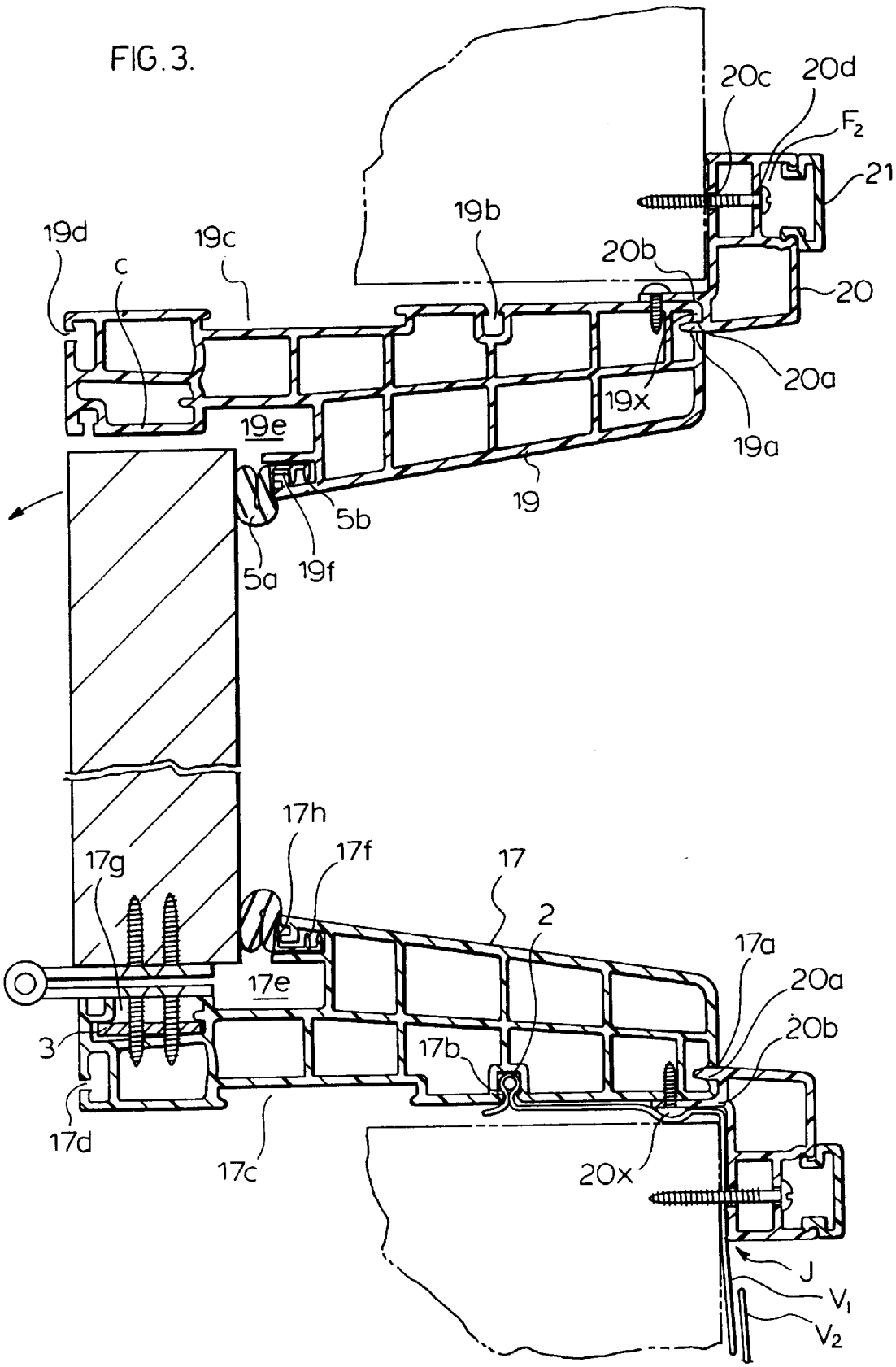
FIG. 3 is a cross-sectional view of the hinge and striker jamb portions of FIG. 1 illustrating the components thereof in a preferred embodiment of the invention.
Figure 4:
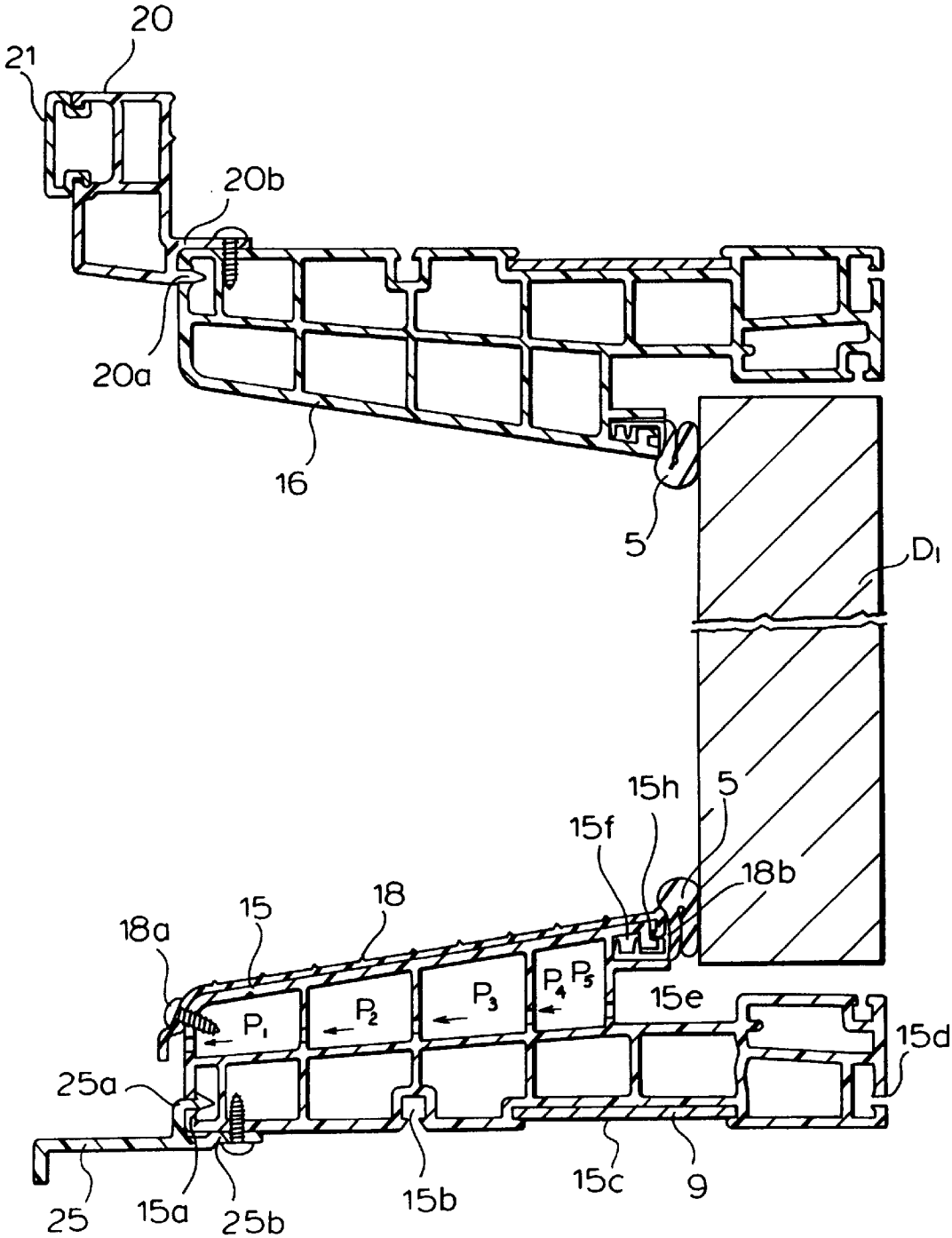
FIG. 4 is a cut-away perspective view of the sill and header jamb sections of FIG. 1 illustrated in a preferred embodiment of the invention and showing the components thereof.

Referring generally to the FIGS. 1 through 6, the present invention deals with a standard extrusion having a profile as best seen in FIG. 2. This profile is utilized for all of the jambs of the framing section including the sill 15, the header 16, the hinge jamb 17, and the striker jamb 19. These jambs therefore are formed from the same standard-sized and -shaped profile as seen in FIGS. 2, 3 and 4. This profile has a generally wedge shape when viewed in cross section and the top tapers from a broad side to a narrow side. Each profile includes a top which is preferably tapered as shown and includes proximate one side a pocket generally referred to as item 15*e* in FIG. 2 within which a wing or door is contained when the door is in the closed position. This is best seen in relation to FIG. 3. The standard-shaped profile also includes a recess 15*f* or the like for receiving a compression seal 5 therein as best seen in FIG. 2 which includes the sealing face 5*a* and a pair of tabs 5*b* and 5*c* which interfit within a pocket 15*f*, for example, of the sill section 15 as best seen in FIG. 2. The top of the sill, for example section 15, tapers from adjacent the seal-receiving pocket 15*f* toward the opposite side of the section. Each side of the section includes a combination slot and tab 15*a* and 15*x* to which is engaged in use a brick molding utilized for mounting the framing sections adjacent the building opening. This is best seen in relation to FIGS. 2 and 3. The brick molding 20 extends about the entire framing section with the exception of the sill wherein a brick molding member 25 is provided which captures the flange 15*x* outside of the groove 15*a* between outwardly extending tang portions 20*a* and 20*b* of brick molding 20. The top of the framing section 15 also includes adjacent the pocket 15*e* proximate the side of the section a groove for retaining a supplementary seal such as a fin seal if necessary. The side of the framing section opposite the groove 15*a* includes groove 15*d* within which the brick molding portion 25 or 20 is inserted in a manner similar to that shown in FIG. 2. This will be described in relation to FIGS. 5 and 6 hereinafter for an outwardly swinging door. The bottom of the framing section includes a channel 15*b* within which a section of rolled foam 2 may be placed when a vapour seal VA is installed with the framing section. This is best seen in relation to FIG. 3 and will also be described hereinafter. This detail is referred to as item 7 in FIG. 2 generically. The bottom of the framing section also includes a wider channel 8 within which a flat bar 9 is provided to provide extra reinforcing of the framing section when required by the installer in situations where there will be heavy loading on the section. An example of such a situation is when the framing sections are installed in a large opening back to back and require reinforcing adjacent a centrally located mullion separating the two doors.

Figure 3A:
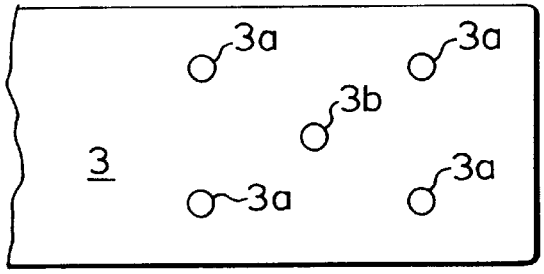
FIG. 3A is a schematic view of the retaining metal backer plate portion, item no. 3, shown in FIG. 3, and illustrated in a preferred embodiment of the invention.

As best seen in FIG. 3, a pocket 17*g* is provided with the framing section within which a metal backing plate insert 3 is located as best seen in FIG. 3 and FIG. 3A which is fastened to the framing section at 3*b* by an appropriate fastener and to which a hinge is fastened via fasteners shown in FIG. 3 within openings 3*a*.

When the framing sections 15, 16, 17 and 18, installed as a sill, a header, a hinge jamb and a striker jamb are installed, substantially as shown in FIG. 1, the brick moldings 20, as best seen in FIG. 2, and specifically labelled as 21, 22 and 23 within FIG. 1, are fastened to the wooden plates adjacent the brick work B as seen in FIG. 1, via a fastener F2 as seen in FIG. 3. The cap 21 is removed from the brick moldings 20 which are retained in position via tabs extending into the pocket within which the fastener is provided. The fastener F2 is therefore driven through openings 20*c* and 20*d* into the wooden plate framing the opening. In this manner, a convenient number of fasteners f2 may therefore be provided around the perimeter of the framing section to fasten it in place within the opening. The sill portion, as best seen in FIG. 2, includes a brick molding 25 which is clipped in place and may be sealed using a suitable silicon sealant or the like. A sill cover plate 18 of any convenient colour is also fixed in position over the top of the framing section provided as the sill 15 clipping at one end within the pocket 15*h* as seen in FIG. 4. The sill cover 18 therefore clips within the recess 15*h* via a tab 18*b* and proximate a fastener 18*a*.

Suitable drain holes P1 through P5 are provided within the interior section of the profile as best seen in FIG. 4. As best seen in FIG. 2, the openings are located below the lower flange 18*c* of the cover plate 18 for the sill of member 15. The ports, or openings, P1 through P5 therefore are drilled in alignment for ports P1 through P4 so as to drain the water accumulated within the sill portion. The pocket 15*e* includes adjacent thereto at port P5 located so as to drain any accumulated water therein as well as best seen in FIG. 4. This port P5 is offset a predetermined amount X as best seen in FIG. 2 to allow for a tortuous path for any air attempting to enter the space from the outside through said ports P1 through P5. The surface 15*y* shown in FIG. 2 is tapered toward the smaller side of the sill portion away from the pocket 15*e* and sloped to provide the water drainage requirements.

Each profile includes a substantial amount of structural reinforcing vertical web members and horizontal web members, unlabelled, so as to provide the necessary rigidity as a framing section, and particularly as a sill member so as to take the normal loads experienced by framing sections of doors. Each reinforcing web portion as best seen in FIG. 2 therefore is separated by a predetermined distance to provide ten cell portions contained within each of the standard profiles substantially in two layers with the exception of the pocket area within which the door is located when closed.

Figure 6:
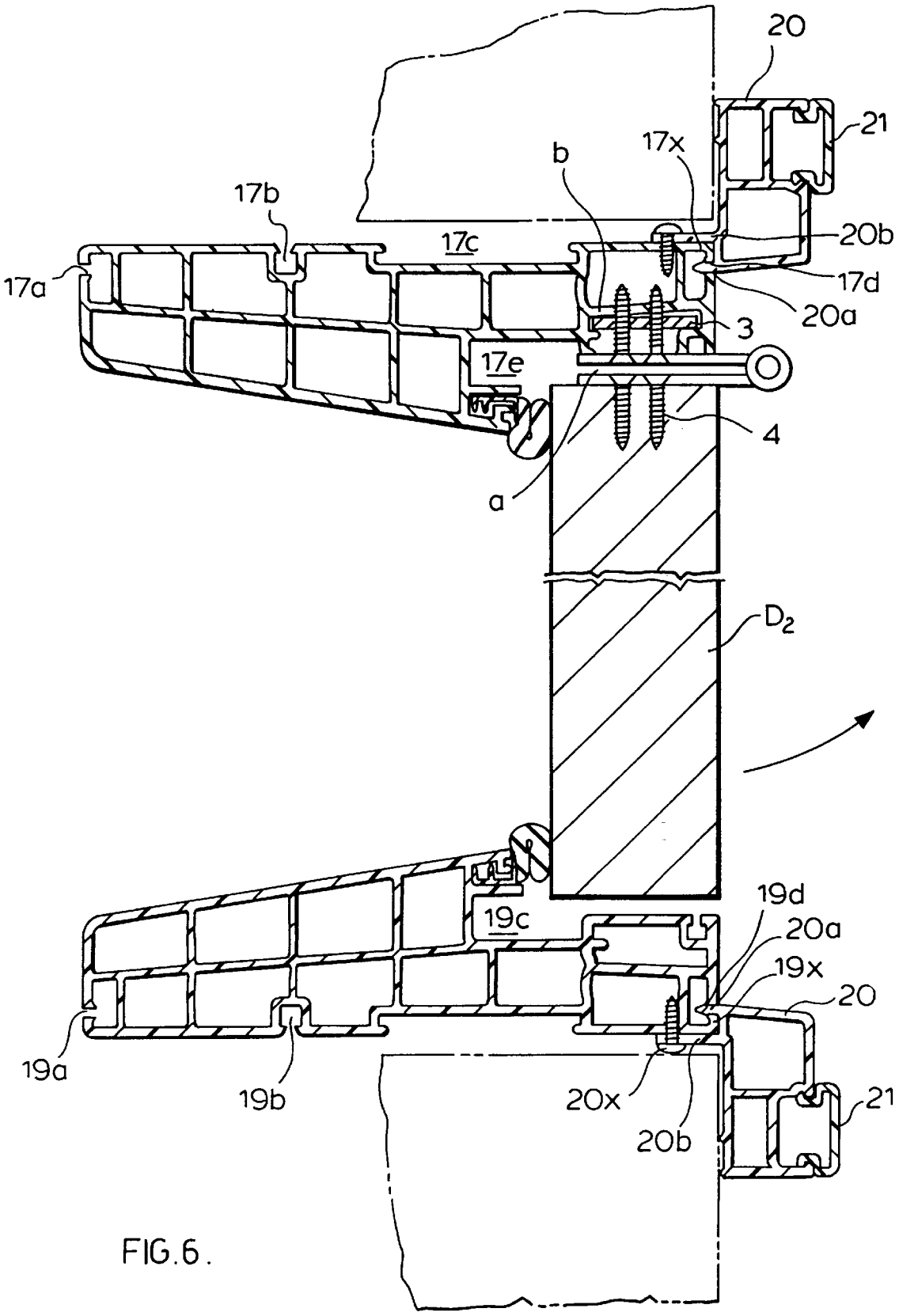
FIG. 6 is a cross-sectional view of an outwardly-swinging door illustrated in a preferred embodiment of the invention.

A standard profile therefore has been provided at 15, 16, 17 and 18 which may be mitered at their ends and joined together by fusion welding and further sealed with silicon as required. This is seen in part in FIG. 2 wherein the adjacent sections 15 and 19 are joined at a mitered joint M which are fusion-welded together. Obviously, the lengths of the framing sections will differ depending on the use thereof. However, for a standard-sized door opening, these framing sections may be assembled prior to shipment for ready fastening in position. Such a framing section therefore is assumed to be fixed within the standard opening size within a building B as seen in FIG. 1. It is required in this scenario that the door D1 pivot in an inward direction into the space of the building. The framing sections therefore are fixed in position to the wooden plates adjacent the brick work of the building B as best seen in FIG. 3. The brick molding portions 20 are therefore engaged within the groove 19*a* capturing the tab 19*x* between the portions 20*a* and 20*b*. The cap 21 is removed from the brick molding 20 and fasteners F2 are therefore driven into the wooden plate, unlabelled, within FIG. 3. This is continued about the entire perimeter of the opening within which the door will be suspended. When installing the brick moldings 20, a vapour seal V1 may be installed substantially as shown in FIG. 3 being held in position within recess 17*b* via a rolled foam rod similar to the rods utilized for holding screen door screens in position. The vapour seal V1 therefore extends from that recess over the fasteners and down the brick molding to a preferred 16" overlap with the building vapour seal V2 as is well known. Typically, a clearance of ⅛" to 3⁄16" is provided between the brick molding and the brick work at joint J wherein a caulking bead may be placed both at the joint J and between the clearance space. The fasteners 20*x* are driven into the pocket as shown in FIG. 3 about the perimeter of the brick molding to fasten said brick molding and said standard profile section together to further reinforce the structure prior to attaching the framing section to the wooden plates. This is also continued around the perimeter of the bottom of the frame. Once the framing sections are supported within the opening from which the door will pivot, the door is supported at the end seen in FIG. 3 within the space defined by the pocket 17*e* and extending from that pocket to the side of the profile. A plate 3, as seen in FIGS. 3 and 3A, is fastened within the opening 17*g* with the fasteners extending through the openings 3*a* once the plate 3 is fastened and positioned via fastener not shown through opening 3*b* through the top wall of each of the sections or cells A and B as best seen in FIG. 6. The door thereafter squared as is well known from the hinges. A strike plate then would be installed on web portion C as best seen in FIG. 3 via the web portion C. An opening is cut within the web portion C and a reinforcing plate, not shown, may also be installed within this area to receive the striker plate. It is a conventional striker plate that is being installed. It is installed in a manner consistent with the reinforcing plate 3 as seen in FIGS. 3 and 3A in a similar manner with the exception of the number of holes for the backer plate so used in that the fasteners so used will also fasten the striker plate in position. The sill cover 18 is then installed as best seen in relation to FIGS. 2 and 4 on the sill 15. The drainage ports P1 through P4 are drilled in position prior to installing this plate from that end of the profile, and the port P5 is drilled offset in relation to the other ports P1 through P4 as best seen in relation to FIG. 2 offset a distance X within the wall of the sections defining the pocket 15*e*. The inwardly-opening door is therefore now fixed in position.

Figure 5:
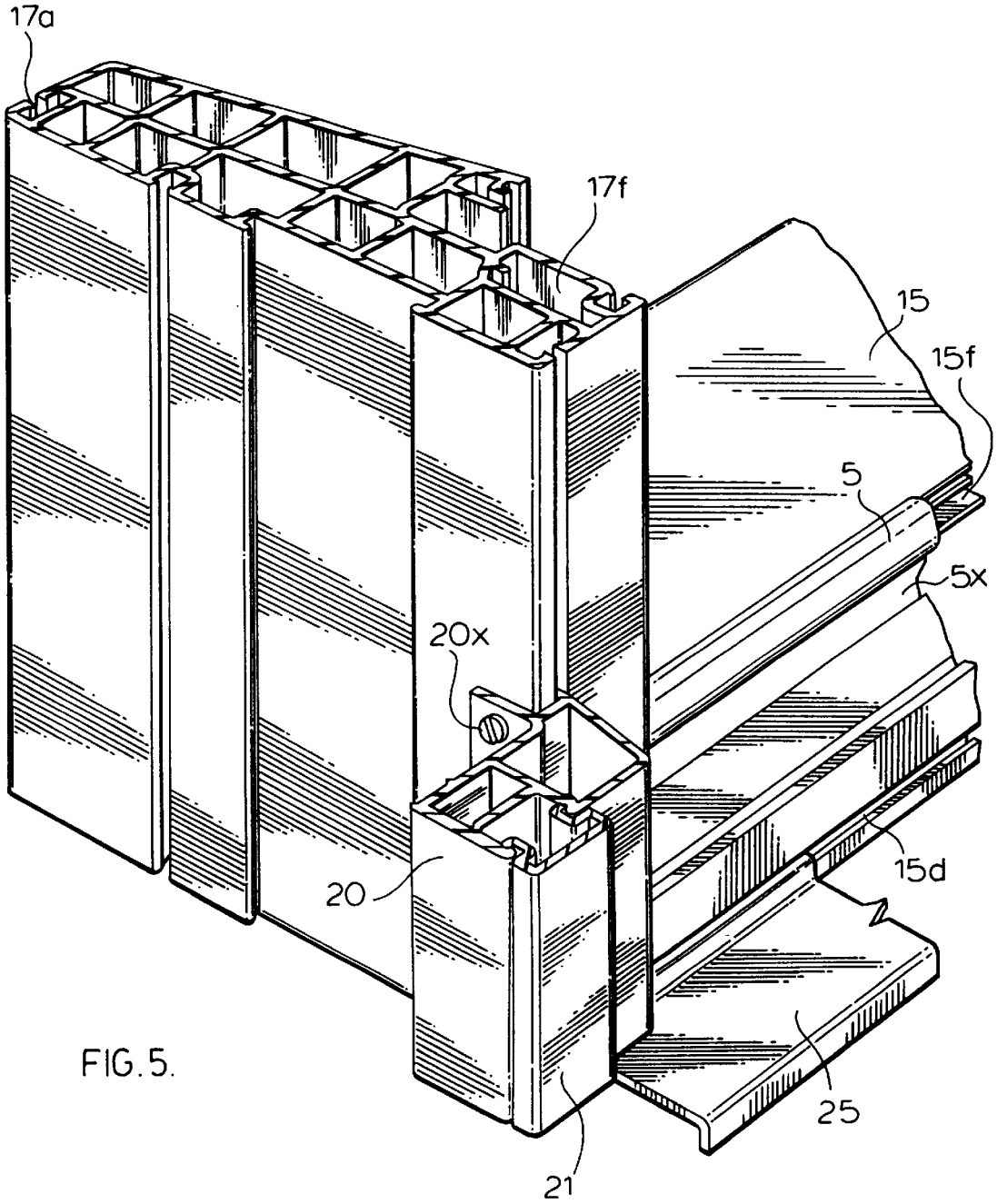
FIG. 5 is a cut-away perspective view in close up of the sill profile 15 and the hinge jamb profile 17 of an outwardly-swinging door installed utilizing the same framing sections as shown in FIG. 1 and illustrated in a preferred embodiment of the invention.

Alternatively, an outwardly-swinging door may be installed in a similar manner to that previously described as illustrated in FIGS. 5 and 6. An installer would typically install a door that opens outwardly away from the space of the building or the room as per the requirements of, for example, the fire code in a particular Province or State. In one example, when an outwardly-opening door includes a crash bar for fire exits or the like, such an installation may be required. Alternatively, when considering the prevailing winds within a particular geographical location, it may be more advantageous to have the door open outwardly or alternatively inwardly.

The present invention finds particular application in such a situation in that the same standard framing section may be used to install both an inwardly- and outwardly-opening door for various openings within one building. The supplier therefore can ship the same assembled standard-sized framing sections which fit standard-sized openings within buildings, for example a standard-sized door opening, and the installer can decide whether that particular framing section will be utilized for an inwardly- or an outwardly-opening door. All of the features described in relation to the inwardly-opening door of FIG. 1 are also applicable to the outwardly-opening door of FIGS. 5 and 6.

Referring now to FIGS. 5 and 6, there is illustrated the framing section for a door D2 which will pivot outwardly away from the building. In this respect, the opening 17*d* or 19*d* will contain the flange 20*a* which will capture between flanges 20*a* and 20*b* of the brick molding, the flange 19*x* and 17*x* as best seen in FIG. 6. Fasteners 20*x* will then fasten the flange 20*b* in the appropriate location as best seen in FIG. 6 via the fasteners 20*x* similar to the manner illustrated in relation to FIG. 3 of fastening the brick moldings 20 via fasteners to the wooden framing plates surrounding an opening. A vapour seal may be installed within the opening 19*b* and further within opening 16*b* with a rolled foam cylindrical retainer as in the manner described in relation to FIG. 3 as well. The door D2 is hung on hinges fastened to metal backing plate 3 in a manner as described in relation to FIGS. 3 and 3A. The brick molding 25 is installed adjacent the sill portion which tapers at 15 away from the door toward the inside of the space being closed by the door. It would therefore not be required to provide drainage ports to drain the space 19*e* which may be drained in an alternative manner by providing an opening toward the outside wall through the various cells on that side of the standard-size shaped profile. The striker plate is installed in a similar manner as described above. In this manner, an outwardly opening door is installed.

The profile therefore finds particular application for suspending doors but may also be used for suspending smaller wings such as windows which pivot outwardly or inwardly.

As many changes may be made to the preferred embodiments without departing from the scope of the invention; it is intended that all material contained herein be interpreted as illustrative of the invention and not in a limiting sense.

The embodiments of the invention in which an exclusive property or privilege is claimed are as follows:

1. A standard substantially hollow profile having a predetermined load carrying ability for use in an assembly of framing sections for supporting a pivoting wing comprising one of a door and window within an opening in a building, said profile comprising a section having a top, two sides and a bottom, said top and bottom having extending within a hollow therebetween reinforcing portions extending substantially between said top and said bottom and joining said top and said bottom, said reinforcing portions creating a predetermined number of closed sections within the interior of said profile which rigidify the load carrying ability of said profile, said profile including proximate the top thereof adjacent one side thereof a pocket within which said wing may be located in use and when the wing is in a closed position, said pocket having disposed adjacent thereto a recess for receiving a seal, when installed in said profile said seal including at least one and preferably two tangs for a friction fit engagement within said recess to retain said seal in position for butting against the wing in a closed position, said profile having disposed proximate each side thereof a detent for engaging with a supplementary mounting member for mounting said profile adjacent a building opening, said detent being disposed proximate each side of said profile, wherein said standard profile may be joined with standard profiles so as to form a framing section which may be installed within openings within a building to pivotably retain said wing.

2. The profile of claim 1 wherein said profile includes a recess proximate the bottom thereof for receiving a rolled foam cylinder to retain a vapour seal therein.

3. The profile of claim 1 wherein the bottom of said profile includes a larger recess to contain a reinforcing section for reinforcing the profile.

4. The profile of claim 1 wherein said profile includes a reinforcing flat bar contained within a reinforcing cell located just adjacent the pocket within which said door will be mounted by hinges, said reinforcing bar for receiving the fasteners of said hinges and reinforcing them in that particular location.

5. The profile of claim 1 wherein the top of said framing section when utilized as a sill may further comprise a supplementary sill cap which is fastened in position proximate the pocket via a recess formed within said profile adjacent said pocket for containing and receiving tangs provided with said supplementary sill cover plate and being fastened proximate the other end via a fastener driven into said profile.

6. The profile of claim 1 wherein drainage holes are formed through said reinforcing portions of said profile to allow for drainage.

7. The profile of claim 6 wherein the horizontal web joining the sides of said profile extending within the hollow thereof is tapered from proximate the pocket and extends to the other side of the profile within the hollow thereof to allow for drainage of said profile.

8. The profile of claim 1 wherein said profile is utilized to prepare a framing section for supportedly pivoting a door, said framing section including a sill, a header, a striker jamb and a hinge jamb, all of said header, sill, striker and hinge jamb portions being mitered and welded or the like proximate the corners thereof and sealed with appropriate sealant to provide a framing section, said framing section being manufactured from the standard profiles and which are mounted to wooden framing plates adjacent the opening of a building via supplementary brick moldings fastened to a preferred side of said profile via the detent provided at those sides depending on the direction said wing will pivot.

9. A framing section for a closure wing, said wing being pivotable proximate one side edge thereof to and from an open and closed position when a free side of the wing is moved to and from the open and closed position, said framing section comprising a standard section profile for providing a sill section, a header section, a striker jamb section and a hinge jamb section, all sections being interconnected at preferably mitered corners and being joined thereat, said framing section being mounted within an opening provided within a building, each framing section being rigidified by reinforcing portions within an interior hollow thereof, each framing section having two sides, a top and a bottom and having disposed proximate the sides thereof means for mounting said framing section to a supplementary portion to be fastened to said building, one side of said framing sections including a pocket located proximate the top of said framing section and extending toward the bottom of said framing section, said pocket also including a channel for receiving a seal, the top of said framing section being tapered toward one side of the section and extending from said pocket to that side, said taper being utilized to allow for the shedding of water, and snow from said framing section, said section also including drainage ports which extend through the reinforced sections within the hollow of the framing section to provide for the draining of water away from said framing section, wherein said framing section is mounted within the building opening by supplementary portions being fastened to normally wooden plates adjacent the opening of said building and wherein said supplementary portions engage with the means for mounting said framing section to the supplementary portions of said profile.

10. The framing section of claim 9 wherein the framing section will allow for the pivoting of the closure wing as a substantially inwardly pivoting wing and alternatively as a substantially outwardly pivoting wing depending on which side of the framing section that a supplementary member is mounted from, said wing residing in use within the pocket provided by said sections and being moveable to and from the pocket defined within the joined framing sections.

11. The framing section of claim 9 wherein said framing sections being joined together at mitered ends and being welded thereat.

12. The framing section of claim 9 wherein a sill cap is placed on the tapered framing section making up a sill for a doorway, said sill cap also being manufactured from a thermoplastic flexible material.

13. The framing section of claim 9 wherein the pocket which provides a recess within which the wing is received in the framing section when the wing is in the closed position also includes a fastening portion for anchoring the hinges of the wing therein using screws and which may include a backing plate for said screws disposed within said hollow reinforcing section.

14. The framing section of claim 9 wherein channels, and grooves are provided within the framing section to incorporate: a seal for sealing the wing within the pocket, a foam rod for retaining a vapour seal to the framing section without using nails, staples and sealant, and a supplementary mounting member.

* * * * *